US005357305A

United States Patent [19]

Long

[11] Patent Number: 5,357,305

[45] Date of Patent: Oct. 18, 1994

[54] APPARATUS FOR PROCESSING PHOTOSENSITIVE MATERIALS

[75] Inventor: Francis C. Long, Rochester, N.Y.

[73] Assignee: Eastman Kodak Company, Rochester, N.Y.

[21] Appl. No.: 749,827

[22] Filed: Aug. 26, 1991

[51] Int. Cl.[5] ..... G03D 5/00

[52] U.S. Cl. ..... 354/318

[58] Field of Search ..... 354/317, 318, 319; 118/661, 662, 681; 492/16-20

[56] References Cited

U.S. PATENT DOCUMENTS

| | | | |
|---|---|---|---|
| 1,757,950 | 5/1930 | Allin . | |
| 3,308,737 | 3/1967 | Fukuda | 95/89 |
| 3,363,530 | 1/1968 | Rice | 354/318 |
| 4,141,314 | 2/1979 | Newson | 118/246 |
| 4,227,797 | 10/1980 | Tsunoi | 355/256 |
| 4,373,469 | 2/1983 | Kuge et al. | 118/652 |

FOREIGN PATENT DOCUMENTS

| | | | |
|---|---|---|---|
| 744243 | 2/1956 | United Kingdom | 354/319 |

*Primary Examiner*—D. Rutledge

[57] ABSTRACT

A photographic processing apparatus intended to process a photosensitive material with first and second processing ingredients includes a belt having first and second porous members located along the belt for absorbing first and second processing ingredients, respectively, and for transferring first and second processing ingredients so absorbed to the photosensitive material. The photosensitive material is moved against the porous members to compress the porous members to release the first and second processing ingredients from the porous members, to cause the first and second processing ingredients to be transferred to the photosensitive material from the porous members and to cause the ingredients to be mixed together to form a processing solution to process the photosensitive material. Furthermore, the movement of the photosensitive material over the porous members provides high agitation resulting in optimal processing of the photosensitive material.

11 Claims, 2 Drawing Sheets

APPARATUS FOR PROCESSING PHOTOSENSITIVE MATERIALS

TECHNICAL FIELD

The invention is related generally to the field of photography; and in particular to a photographic processing apparatus.

BACKGROUND ART

An unstable processing solution may be created when processing ingredients, for example a developer fluid and an activator, are mixed together. The unstable processing solution will have a tendency to deteriorate over a short period of time, thus a relatively small amount of exposed photosensitive material can be processed before the unstable solution would have to be discarded.

A new processing solution would have to be created each time the unstable processing solution is discarded. This can be time consuming for the operator of the processing apparatus.

DISCLOSURE OF INVENTION

According to the invention, there is provided a photographic processing apparatus intended to process a photosensitive material with first and second processing ingredients. The photographic processing apparatus includes a series of discrete liquid-absorbing/-releasing means and applicator means for applying a first processing ingredient and a second processing ingredient to respective ones of said liquid-absorbing/-releasing means in a recurring succession to first cause one of the liquid-absorbing/-releasing means to absorb the first processing ingredient and then another of the liquid-absorbing/-releasing means to absorb the second processing ingredient. The photographic processing apparatus also includes transport means for moving respective ones of said liquid-absorbing/-releasing means and a photosensitive material into mutual contact to release a first processing ingredient and a second processing ingredient onto the photosensitive material in a recurring succession to mix the first and second processing ingredients along the photosensitive material.

Another aspect of the invention is directed to a photographic processing ingredient applicator for applying a processing ingredient to a porous material. The applicator includes a tank for holding a processing ingredient and a pressure roller submersed in a processing ingredient in the tank. A compressible/expandable porous roller is mounted for eccentric rotation and located adjacent the pressure roller. The processing applicator also includes means for rotating the porous roller to cause the porous roller to be rotated against said pressure roller to compress the porous roller and away from the pressure roller to allow expansion of the porous roller to cause the porous roller to absorb a processing ingredient in said tank and for rotating the porous roller to cause the porous roller to be rotated against the porous material to compress the porous roller to cause the processing ingredient to be transferred to the porous material.

The present invention is directed to a photographic processing apparatus which will optimally process a photosensitive material with minimal amounts of processing ingredients. Furthermore, the processing apparatus will reduce the amount of unstable processing solutions which require recycling or disposal.

BRIEF DESCRIPTION OF DRAWING

Other advantages of the invention will become apparent from the following description taken in connection with the accompanying drawing wherein.

MODES OF CARRYING OUT THE INVENTION

Because photographic processors and the general operations associated therewith are well known in the art, the description hereinafter will be directed in particular only to those processor parts relevant to the present invention. It is to be understood, however, that processor components not specifically shown or described may take various forms selectable from those known in the art.

Figure 1:
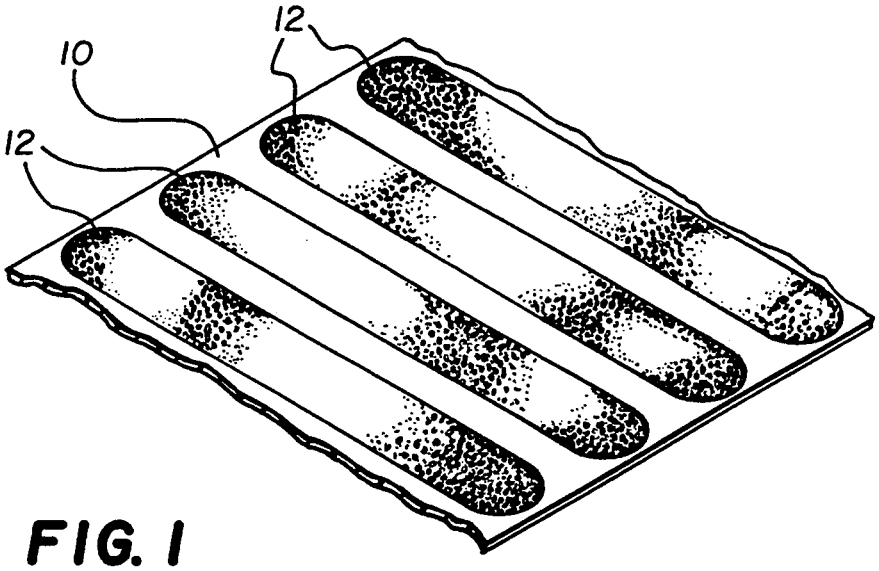
FIG. 1 is a perspective view of a support for use in a photographic processing apparatus according to the present invention.

Referring now to FIG. 1 a portion of a photographic processing apparatus is shown. In particular, a support 10 having a series of liquid-absorbing/-releasing means 12 is shown. In general, the liquid-absorbing/-releasing means 12 absorb a processing ingredient and transfer the processing ingredient to a photosensitive material.

Figure 2:
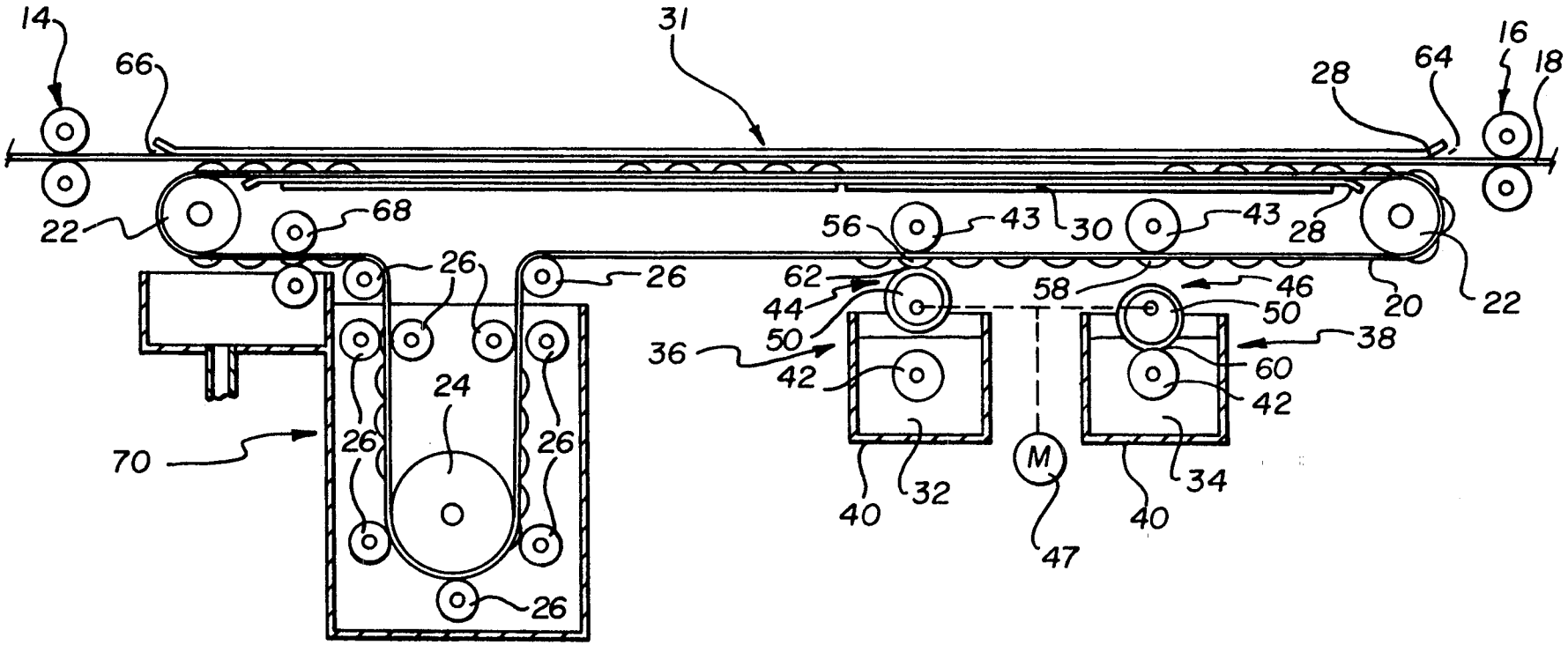
FIG. 2 is a schematic of a photographic processing apparatus according to a preferred embodiment of the invention.

A photographic processing apparatus utilizing the support 10 with the liquid-absorbing/-releasing means 12 is shown in FIG. 2. The photographic processing apparatus includes pairs of transport rollers 14 and 16 for moving a photosensitive material 18 against the liquid-absorbing/-releasing means 12 on the support 10. In accordance with a preferred embodiment, the support 10 includes a belt 20 to which the liquid-absorbing/-releasing means 12 are attached. The belt 20 is moved through the photographic processing apparatus by rollers 22,24,26 at a speed different than the speed the photosensitive material 18 is transported through the processing apparatus. The significance of the speed difference will be explained below. A pair of containment plates 28 define a path through which the photosensitive material 18 and the belt 20 are moved.

A conventional heater 30 is located in the vicinity of the containment plates 28 to maintain the temperature of a photosensitive material processing area 31.

The liquid-absorbing/-releasing means 12 depicted most clearly in FIG. 1 have a rounded shape and extend across the width of the belt 20. The liquid-absorbing/-releasing means 12 can be made from any absorbent material such as an open cell foam. Alteratively, the liquid-absorbing/-releasing means 12 can take the shape of a series of randomly patterned circular bumps(not shown). The liquid-absorbing/-releasing means 12 are attached by any well known means such as adhesive or heat staking to the belt 20 which is made from a material which will not absorb a photographic processing ingredient.

Figure 3:
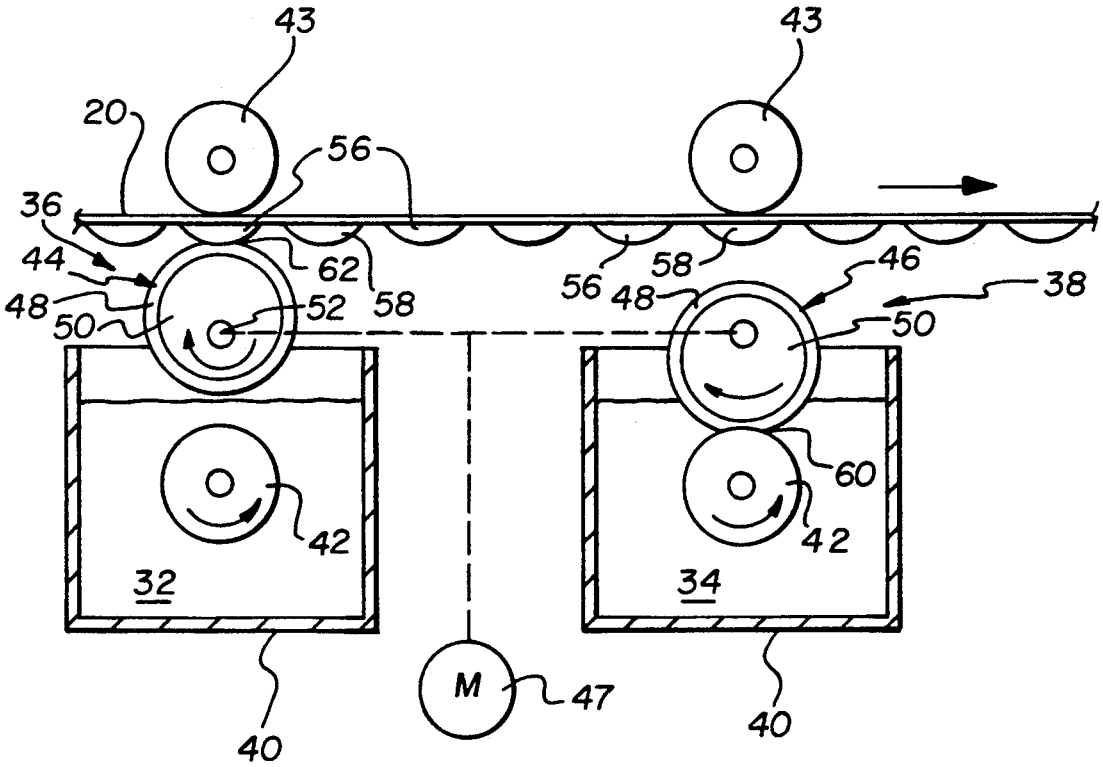
FIG. 3 is an enlarged view of a photographic processing ingredient applicator according to the invention.

First and second processing ingredients 32,34 are applied to the liquid-absorbing/-releasing means 12 by first and second photographic processing ingredient applicators 36,38, shown most clearly in FIG. 3. The two photographic processing ingredient applicators 36,38 are generally identical and their parts are designated by like reference numerals except where a difference exists. Each assembly includes a tank 40 for holding the first and second processing ingredients 32,34 respectively. A pressure roller 42 is submersed in the processing ingredient in each of the tanks 40 and a pressure roller 43 is located above the tanks 40 and vertically aligned with each pressure roller 42. Each applicator assembly 36,38 further includes first and second porous rollers 44 and 46, respectively, mounted for eccentric rotation for absorbing the processing ingredient contained in the tank 40 and transferring the processing ingredient to the liquid-absorbing/-releasing means 12. The porous rollers 44,46 are located between the pressure rollers 42 and the liquid-absorbing/-releasing means 12 attached to the belt 20 such that the porous rollers 44 and 46 will contact the pressure rollers 42 and the liquid-absorbing/-releasing means 12 when the porous rollers 44,46 are rotated by any conventional drive means 47.

The porous rollers 44,46 are each typically manufactured by adhering an absorbent material 48 such as an open cell foam to a rigid shaft 50. The type of absorbent material utilized will depend upon the type of processing ingredients required to process the photosensitive material 18. The dimensions of the absorbent material 48 can depend upon the amount of the processing ingredient to be transferred to the photosensitive material 18. The porous rollers 44,46 are generally cylindrical in shape, but can take a relatively oval shape, having a rotational axis 52 offset from a central axis of the porous roller.

In accordance with the embodiment shown in FIG. 2, the liquid-absorbing/-releasing means 12 include first porous members 56 and second porous members 58 attached to the belt 20 in an alternating pattern. The first processing ingredient 36 will be absorbed by the porous roller 44 and the second processing ingredient 38 will be absorbed by the porous roller 46 when the porous rollers 44 and 46 are in a first position 60. The first processing ingredient 36 will be transferred from the porous roller 44 to the first porous member 56 and the second processing ingredient 38 will be transferred from the porous roller 46 to the second porous member 58 when the porous rollers 44 and 46 are in a second position 62.

The positioning and timing of the porous rollers 44 and 46 will depend upon the amount of the first and second processing ingredients 32,34 required to process the photosensitive material 18 being transported through the photographic processing apparatus. For instance, as shown in FIGS. 2 and 3, the porous roller 44 approaches the second position 62, transferring the first processing ingredient 36 to the first porous member 56 as the porous roller 46 approaches the first position 60, absorbing the second processing ingredient 38.

Alternatively, if more of the first processing ingredient 36 is required to process the photosensitive material 18 than the second processing ingredient 38 some modifications (not shown) to the photographic processing apparatus would be required. For example, the porous members 12 could be arranged on the belt 20 in a recurring succession such as having two first porous members 56 and one second porous member 58, or any other appropriate combination. Some type of control logic could be incorporated to control the rotation of the porous rollers 44,46 and the movement of the belt 20. Furthermore, the processing ingredient applicators could be arranged in a recurring succession such as having two first processing ingredient applicators and one second processing ingredient applicator, or any other appropriate combination.

Of course, as mentioned previously, the amount of first and second processing ingredients transferred to the photosensitive material can be controlled by the dimensions of the absorbent material attached to the rigid shaft of the porous rollers.

The belt 20 having the porous members 56,58 saturated with first and second processing ingredients 36,38, respectively, is transported towards the photosensitive material processing area 31. The photosensitive material 18 to be processed will approach the processing area 31 as the belt 20 approaches the processing area 31. As mentioned previously, the belt 20 and the photosensitive material 18 are transported through containment plates 28. The containment plates 28 are spaced apart a specific distance so that a predetermined pressure is created between the photosensitive material 18 and the porous members 56,58. The pressure created between the photosensitive material 18 and the porous members 56,58 should be sufficient to compress the porous members 56,58 so that a portion of the first and second processing ingredients 32,34 are transferred to the photosensitive material 18 at an entrance 64 of the containment plates 28 and the first and second processing ingredients 32,34 are continually transferred to the photosensitive material 18 until the photosensitive material 18 reaches an exit 66 of the containment plates 28.

In accordance with the preferred embodiment, the belt 20 is moved through the containment plates 28 at a slower speed than the photosensitive material 18. This difference in speed allows the first and second processing ingredients 32,34 to be properly mixed along the photosensitive material 18 after the processing ingredients are transferred to the photosensitive material 18 to create a processing solution. Furthermore, the difference in speed between the belt 20 and the photosensitive material 18 provides proper agitation for the processing solution resulting in optimal processing of the photosensitive material 18.

Processing ingredients remaining in the first and second porous members 56,58 after the photosensitive material 18 is processed are removed by a pair of squeegee rollers 68. The excess processing ingredients can then be recycled. The belt 20 then passes through a belt wash tank 70 to clean the belt 20 and porous members 56,58. The belt 20 is then transported through a pair of squeegee rollers (not shown) to remove excess fluid from the belt and porous members 56,58.

The operation of the photographic processing apparatus will be described referring to FIG. 2. Power is supplied to the photographic processing apparatus either by an on/off switch (not shown) or by detecting the photosensitive material 18 being inserted into the photographic processing apparatus.

The porous roller 44 begins rotating so that it rotates against the pressure roller 42 which causes the porous roller 44 to compress upon contact with the pressure roller 42. The first processing ingredient 32 will be absorbed by the porous roller 44 as the porous roller 44 continues to rotate and breaks contact with the pressure roller 42 and expands. The porous roller 44 continues to rotate towards the first porous member 56. The porous roller 44 will compress as it contacts the first porous member 56 thus releasing and transferring the first processing ingredient 32 to the first porous member 56.

The porous roller 46 will absorb the second processing ingredient 34 and transfer it to the porous member 58 in a similar manner that the porous roller 44 absorbs the first processing ingredient 32 and transfers it to the first porous member 56.

The first and second processing ingredients 32,34 are then transferred to the photosensitive material 18 as the belt 20 and the photosensitive material 18 enter the photosensitive material processing area 31 defined by the containment plates 28. The movement of the photosensitive material 18 against the porous members 56,58 will mix the first and second processing ingredients 32,34 together forming a processing solution to process the photosensitive material. Also, the processing solution will be agitated by the movement of the photosensitive material 18 for optimal processing of the photosensitive material 18.

The first and second processing ingredients 32,34 will continue to be released from the first and second porous members 56,58 and transferred to the photosensitive material 18 until the belt 20 and the photosensitive material 18 exit the photosensitive material processing area 31.

The belt 20 is transported through the squeegee rollers 68 to remove any excess processing ingredients from the porous members 56,58. The processing ingredients 32,34 can then be either recycled or collected in a container and disposed of properly.

The belt 20 is then transported to the belt wash tank 70 for cleaning the belt 20 and the porous members 56 and 58.

There is thus provided a photographic processing apparatus which reduces the amount of unstable processing solutions which would need to be disposed of because the processing ingredients which create the processing solution when mixed together are mixed together at the surface of the photosensitive material. The processing ingredients are uniformly applied to the photosensitive material to be processed and uniformly mixed together. Furthermore, the action of the photosensitive material moving against the liquid-absorbing/-releasing means creates a relatively high agitation resulting in optimal processing of the photosensitive material.

The present invention has been described in detail with particular reference to a preferred embodiment thereof, but it will be understood that variations and modification can be effected within the spirit and scope of the invention.

I claim:

1. A photographic processing apparatus intended to process a photosensitive material with first and second processing ingredients, said photographic processing apparatus comprising:

a series of discrete liquid-absorbing/-releasing means;

applicator means for applying a first processing ingredient and a second processing ingredient to respective ones of said liquid-absorbing/-releasing means in a recurring succession to first cause one of the liquid-absorbing/-releasing means to absorb the first processing ingredients and then another of the liquid-absorbing/-releasing means to absorb the second processing ingredient; and transport means for moving respective ones of said liquid-absorbing/-releasing means and a photosensitive material into mutual contact to release a first processing ingredient and a second processing ingredient onto the photosensitive material in a recurring succession to mix the first and second processing ingredients along the photosensitive material.

2. A photographic processing apparatus intended to process a photosensitive material with first and second processing ingredients, said photographic processing apparatus comprising:

a single support including a series of porous means for collectively absorbing first and second processing ingredients in a recurring succession and for transferring first and second processing ingredients so absorbed to a photosensitive material in a recurring succession.

3. A photographic processing apparatus as defined in claim 2, wherein said support has a width and said series of porous means include discrete porous members each located across the width of said support in spaced relation.

4. A photographic processing apparatus as defined in claim 2, wherein each one of said porous means is compressible to release one of first and second processing ingredients absorbed by that porous means, and further comprising:

first means for moving a photosensitive material successively against each one of said porous means to successively compress each one of said porous means to release first and second processing ingredients in a recurring succession onto the photosensitive material to cause the ingredients to be mixed along the photosensitive material.

5. A photographic processing apparatus as defined in claim 4, further comprising:

second means for moving said support in the same direction as a photosensitive material is transported by said first moving means and for moving said support at a different speed than the photosensitive material is transported by said first moving means.

6. A photographic processing apparatus as defined in claim 2, wherein said series of porous means includes first porous members and second porous members located along said support in an alternating pattern, and the photographic processing apparatus further comprising:

first means for applying a first processing ingredient to said first porous members; and second means for applying a second processing ingredient to said second porous members.

7. A photographic processing apparatus as defined in claim 6, wherein said first and second applying means each include a tank for holding a processing ingredient, a pressure roller submersed in a processing ingredient in said tank, a compressible/expandable porous roller mounted for eccentric rotation located adjacent said pressure roller and means for rotating said compressible/expandable porous roller to cause said porous roller to be rotated against said pressure roller to compress said compressible/expandable porous roller and away from said pressure roller to allow expansion of said compressible/expandable porous roller to cause said compressible/expandable porous roller to absorb a processing ingredient in said tank and for rotating said compressible/expandable porous roller to cause the porous roller to be rotated against said porous members to compress the porous roller to cause the processing ingredient to be transferred to said porous members.

8. A photographic processing ingredient applicator for applying a processing ingredient to a porous material, said applicator comprising:

a tank for holding a processing ingredient;

a pressure roller submersed in a processing ingredient in said tank;

a compressible/expandable porous roller mounted for eccentric rotation located adjacent said pressure roller; and means for rotating said compressible/expandable porous roller to cause the porous roller to be rotated against said pressure roller to compress the porous roller and away from said pressure roller to allow expansion of the porous roller to cause the porous roller to absorb a processing ingredient in said tank and for rotating the porous roller to cause said porous roller to be rotated against said porous material to compress the porous roller to cause the processing ingredient to be transferred to said porous material.

9. A photographic processing ingredient applicator for applying first and second processing ingredients to a porous member, said applicator comprising:

first applicator means for absorbing a first processing ingredient when said first applicator means is in a first position and for transferring the first processing ingredient to a porous member when said first applicator means is in a second position;

second applicator means for absorbing a second processing ingredient when said second applicator means is in a first position and for transferring the second processing ingredient to a porous member when said second applicator means is in a second position; and means for controlling said first and second applicator means to cause said first applicator means to approach said first position while said second applicator means approaches said second position.

10. A photographic processing ingredient applicator as defined in claim 9, wherein said first and second applicator means each include a tank for holding a processing ingredient, a pressure roller submersed in a processing ingredient in said tank, a compressible/expandable porous roller mounted for eccentric rotation located adjacent said pressure roller and means for rotating said compressible/expandable porous roller to said first position to cause the porous roller to absorb a processing ingredient in said tank and for rotating the porous roller to said second position to cause the processing ingredient to be transferred to said porous member.

11. A method for applying a processing ingredient contained in a tank to a porous material, said method comprising the steps of:

a. compressing a portion of a porous roller;

b. absorbing the processing ingredient into the porous roller by expanding the portion of the porous roller;

c. contacting the porous material with the porous roller; and d. transferring the processing ingredient from the porous roller to the porous material by compressing the portion of the porous roller.

* * * * *